US006994292B2

(12) United States Patent
Cain et al.

(10) Patent No.: US 6,994,292 B2
(45) Date of Patent: Feb. 7, 2006

(54) DISPENSING APPARATUS FOR WEB MATERIAL

(75) Inventors: Kara Marie Cain, Cincinnati, OH (US); John Patrick Goodall, Cincinnati, OH (US); John Dwayne Walther, Loveland, OH (US); Jason Merrill Jones, Cincinnati, OH (US); Donald William Yelton, Villa Hills, KY (US); Jennifer Hope Dolan, Cincinnati, OH (US); Jason Patrick Shaw, Maineville, OH (US); Shawn Charlton Snyder, Lawrenceburg, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 397 days.

(21) Appl. No.: 10/273,874

(22) Filed: Oct. 18, 2002

(65) Prior Publication Data

US 2004/0075015 A1 Apr. 22, 2004

(51) Int. Cl.
*B65H 16/02* (2006.01)

(52) U.S. Cl. ..... 242/595; 221/303

(58) Field of Classification Search ..... 242/594.1, 242/595, 588.3; 206/409; 221/303
See application file for complete search history.

(56) References Cited

U.S. PATENT DOCUMENTS

| | | | | |
|---|---|---|---|---|
| 3,368,522 A | | 2/1968 | Cordis | |
| 3,756,483 A | | 9/1973 | Schraeder | |
| 3,843,034 A | | 10/1974 | Lewandowsky | |
| 4,638,921 A | | 1/1987 | Sigl et al. | |
| 6,273,359 B1 | | 8/2001 | Newman et al. | |
| 6,382,552 B1 | * | 5/2002 | Paul et al. | 242/595 |
| D481,893 S | * | 11/2003 | Walther et al. | D6/518 |

FOREIGN PATENT DOCUMENTS

| | | |
|---|---|---|
| WO | WO 00/65973 A1 | 11/2000 |
| WO | WO 00/65975 A1 | 11/2000 |
| WO | WO 01/76436 A1 | 10/2001 |
| WO | WO 01/76438 A1 | 10/2001 |
| WO | WO 01/76439 A1 | 10/2001 |
| WO | WO 01/76440 A1 | 10/2001 |
| WO | WO 01/82765 A1 | 11/2001 |
| WO | WO 01/89937 A2 | 11/2001 |
| WO | WO 02/21988 A1 | 3/2002 |
| WO | WO 02/32281 A1 | 4/2002 |
| WO | WO 02/41742 A1 | 5/2002 |
| WO | WO 02/43546 A1 | 6/2002 |
| WO | WO 02/43547 A1 | 6/2002 |

* cited by examiner

*Primary Examiner*—John Q. Nguyen
(74) *Attorney, Agent, or Firm*—David K. Mattheis; David M. Weirich; Ken K. Patel

(57) ABSTRACT

A dispensing apparatus for web materials is disclosed. The dispensing apparatus comprises a support element adapted to support a supply of web material, a first dispensing rib, a second dispensing rib opposing the first dispensing rib, and a turning rib. The first dispensing rib and the second dispensing rib define a dispensing orifice. The turning rib is disposed parallel to the dispensing orifice and occludes the dispensing orifice.

19 Claims, 7 Drawing Sheets

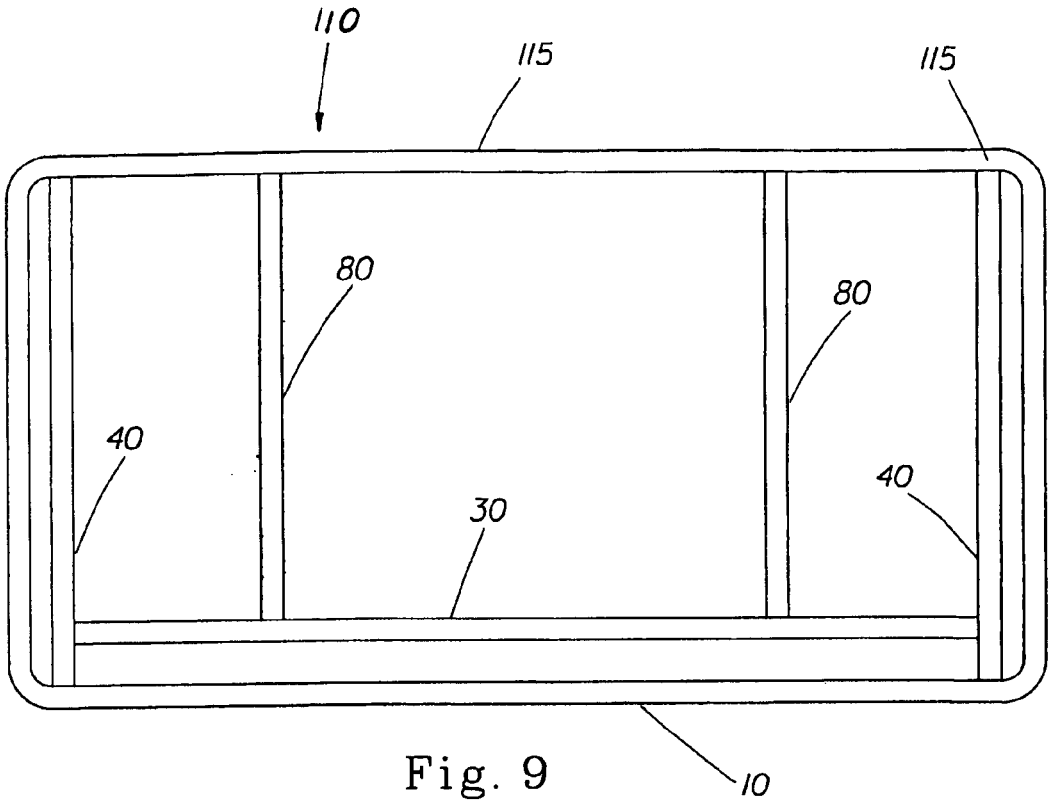
Fig. 9
Fig. 10
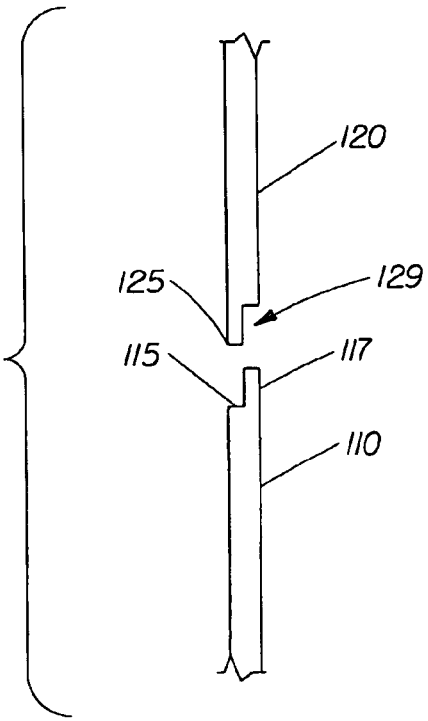

DISPENSING APPARATUS FOR WEB MATERIAL

FIELD OF THE INVENTION

The invention relates to dispensers for web materials. The invention relates particularly to dispenser for wet wipe materials.

BACKGROUND OF THE INVENTION

Web materials are a part of daily life. Metal foils, plastic films, non-woven web, bath tissue and paper towels are all examples of web materials. Webs moistened with a functional liquid, or wet wipes are also a ubiquitous part of daily life. In the use of web materials the dispensing of a desired amount of web—no more and no less than the amount desired is problematic. A particular problem arises when it is desired to dispense a desired amount of web using only one hand rather than one hand to dispense and one hand to hold the supply of web during dispensing.

The dispensing of wet wipes presents the additional challenge of providing a dispensing apparatus that preserves the moisture content of the supply of wipes while also enabling the desired amount of web may be dispensed easily.

The present invention provides a simple dispensing apparatus for web material that enables the dispensing of a desired amount of material. The invention also provides a dispensing apparatus for wet wipes that preserves the moisture content of a supply of wipes at a useful level over the life of the supply while enabling easy dispensing of the wipes.

SUMMARY OF THE INVENTION

The invention comprises an apparatus for dispensing web materials. In one embodiment the apparatus comprises a support element adapted to support a supply of web material, a first dispensing rib, a second dispensing rib opposed to the first dispensing rib, the first dispensing rib and the second dispensing rib defining a dispensing orifice, a turning rib is interposed between the web supply and the dispensing orifice such that the turning rib occludes the dispensing orifice. The turning rib is distinct and offset from the dispensing ribs such that an open space is present between the turning rib, the first dispensing rib, and the second dispensing rib. The dispensed web must be routed around the turning rib and between the dispensing ribs. The turning rib alters the dispensing angle of the web from the dispensing angle of a dispensing apparatus without the turning rib. The turning rib also requires a significant change in the direction of the path of the web as the web is routed from the web supply to the dispensing orifice.

In another embodiment, the apparatus further comprises a decorative outer shell. The decorative shell further comprises portions that may be partially separated to permit the insertion of the web supply material. In embodiments for the dispensing of wet web materials, at least a portion of the shell is sealed when the shell portions are joined.

DESCRIPTION OF THE FIGURES

FIG. 9 is a schematic top view of the first portion of the dispensing apparatus of FIG. 8 showing the interior details of the first portion.

FIG. 10 is a schematic cross section of the mating surfaces of the embodiment shown in FIG. 8, viewed perpendicular to the walls of the dispensing apparatus.

DETAILED DESCRIPTION OF THE INVENTION

The dispensing apparatus 1000 of the invention may be used to dispense webs of any material. Metal foils, paper webs, and webs of non-woven materials may all be dispensed using the dispensing apparatus of the invention.

Figure 1:
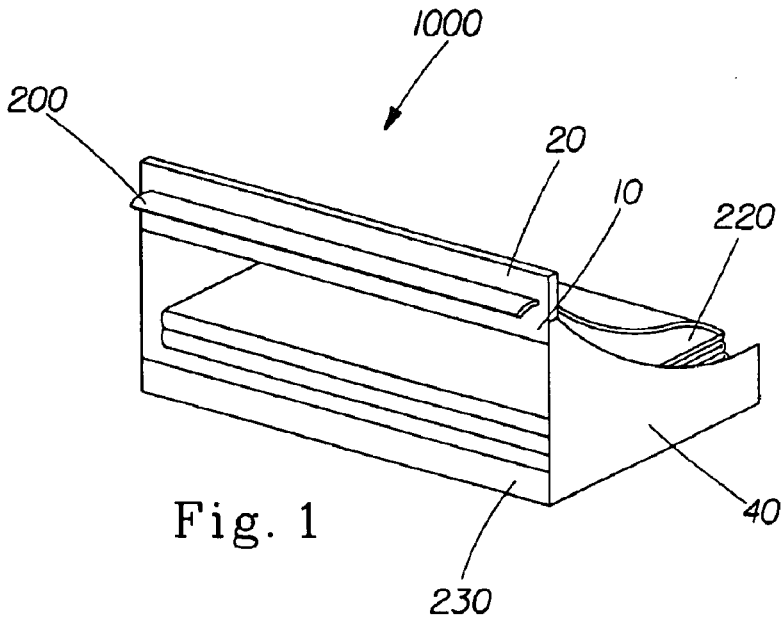
FIG. 1 is a schematic isometric view of an exemplary embodiment of the dispensing apparatus having a stacked web supply.
Figure 2:
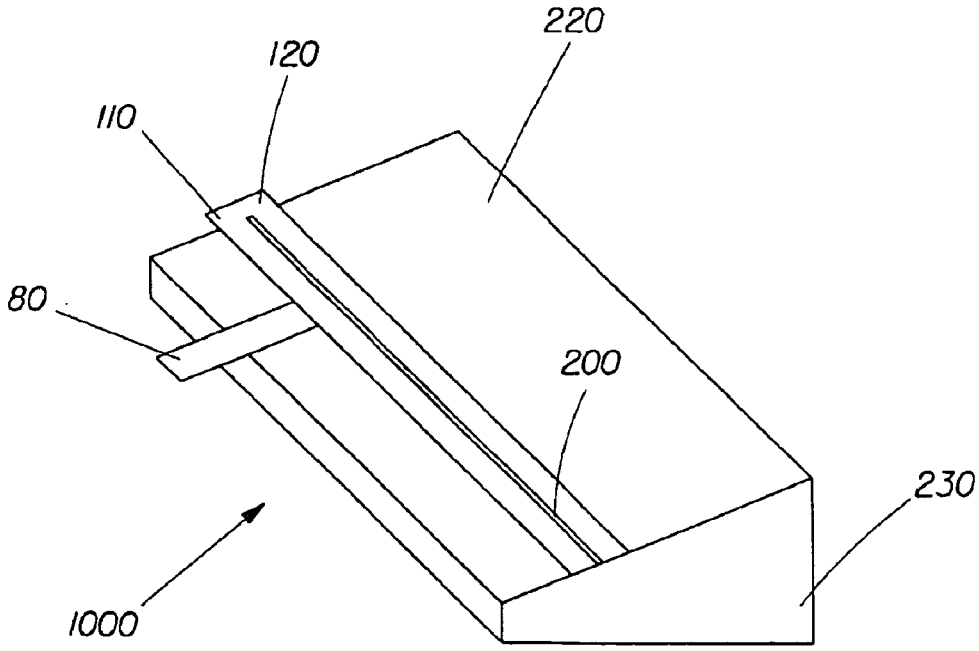
FIG. 2 is schematic front view of an embodiment of the dispensing apparatus having a rolled web supply.

The web material 200 is dispensed from a web supply 220. The web supply 220 may take the form of a stack of interleaved single sheets of web material as illustrated in FIG. 1, or as a continuous roll of web material as illustrated in FIG. 2. The continuous roll of web material may have periodic weak points, or partial perforations, to facilitate the separation of portions of the web 200 as the web is dispensed.

As illustrated in FIG. 1 and FIG. 2, the dispensing apparatus 1000 comprises a support element 230 adapted to support the web supply 220. The web supply 220 rests against and is supported by the support element 230. In the embodiment illustrated in FIG. 2 the support element 230 supports an end face of the web supply 220. A roll of web material may be supported by the core of the roll for cored rolls, or on the end surface of the roll or on the circumference of the roll. The roll may be supported by a combination of the above. In the embodiment illustrated in FIG. 1 the support element 230 comprises a surface that the web supply 220 rests upon. The support element 230 provides a position for the web supply 220 without interfering with the dispensing of the web 200.

Figure 3:
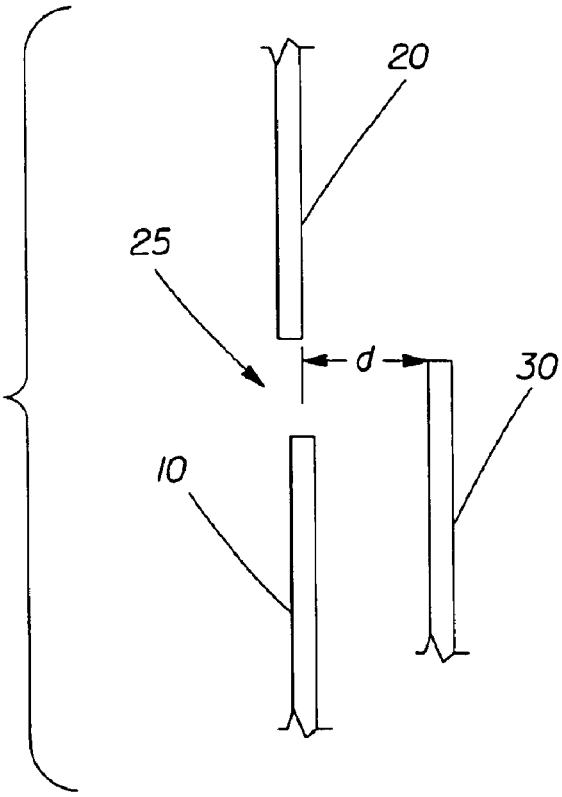
FIG. 3 is schematic cross sectional view of a particular embodiment of the first dispensing rib, the second dispensing rib, and the turning rib taken across the path of the web material.
Figure 4:
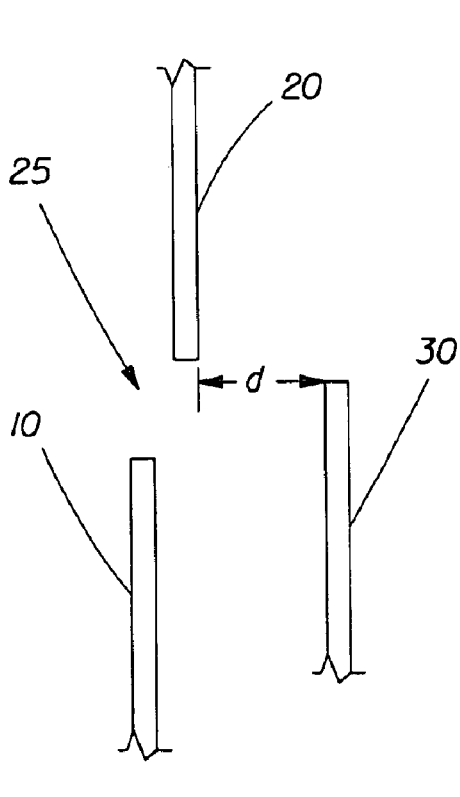
FIG. 4 is schematic cross sectional view of an alternative embodiment of the first dispensing rib, the second dispensing rib, and the turning rib taken across the path of the web material.
Figure 5A:
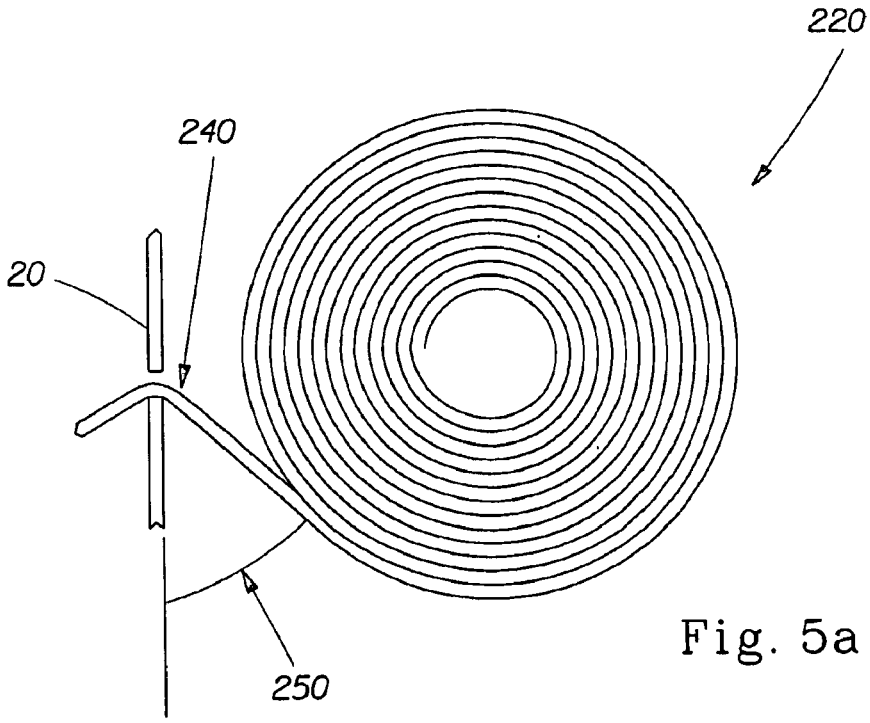
FIG. 5*a* is schematic cross sectional view of yet another embodiment of the first dispensing rib, the second dispensing rib, taken across the path of the web material showing the dispensing angle of the dispensing apparatus without the turning rib.

Referring to FIG. 3, FIG. 4, and FIGS. 5*a,* 5*b,* a first dispensing rib 10, is opposed by a second dispensing rib 20. The opposing edges of the first dispensing rib 10 and the second dispensing rib 20 define a dispensing orifice 25. The web 200 is dispensed from the web supply 220 through the dispensing orifice 25 along a web path 240.

A turning rib 30, is disposed substantially parallel to the dispensing orifice 25, and occludes the orifice 25. An imaginary plane passing through the orifice 25 along the web path 240 must necessarily pass through the turning rib 30. The turning rib 30 increases the tortuosity of the web path 240. The increase in web path 240 tortuosity improves control of the speed of the web 200 during dispensing, and also reduces the likelihood of the undispensed portion of the web 200 falling back into the dispensing apparatus. The turning rib 30 adds at least one change of direction to the web path 240. The change of direction is at least about 90 degrees. The change of direction refers to the angle between the web 200 approaching the turning rib 30 and leaving the turning rib 30.

Figure 5B:
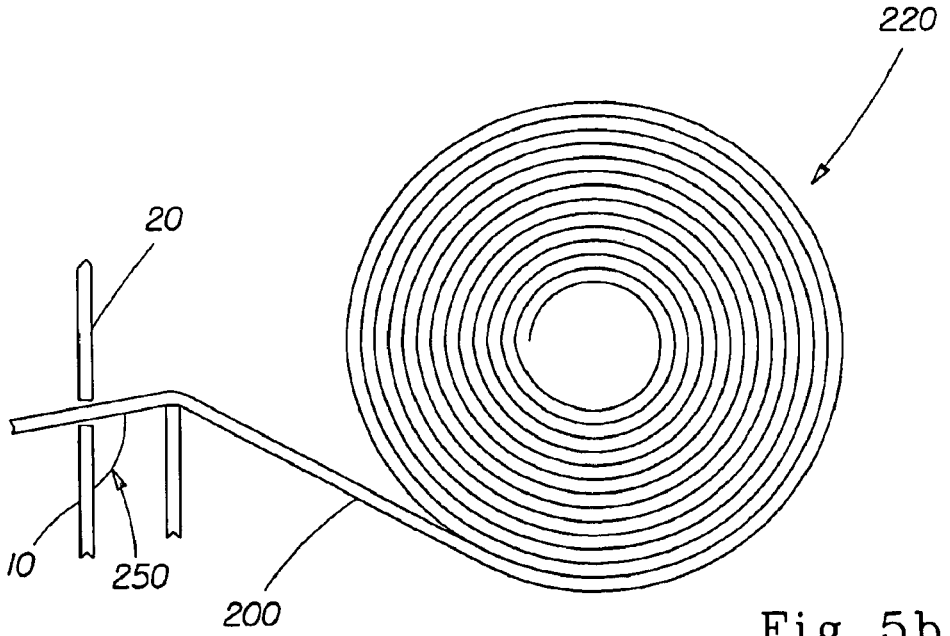
FIG. 5*b* is a schematic cross section of the dispensing apparatus showing the dispensing angle of a dispensing apparatus with a turning rib.

The change in direction of the web path 240 by the turning rib 30 increases the dispensing angle 250 of the web path 240 by at least about 60 degrees. The turning rib 30 may increase the dispensing angle of the web path 240 by up to about 180 degrees. FIG. 5*a* and FIG. 5*b* illustrate change in direction of the web path 240 and the increase in the dispensing angle 250 of the web path 240. FIG. 5*a* illustrates the dispensing angle 250 without the turning rib 30. FIG. 5*b* illustrates the dispensing angle 250 with the turning rib 30. In the embodiment illustrated in FIG. 3 the turning rib 30 increases the angle of the web path 240 by about 90 degrees. The dispensing angle 250 of the web path 240 is the angle at which the web 200 approaches the dispensing orifice 25 from the web supply 220.

The turning rib 30 is offset from the dispensing orifice 25 by a distance d as illustrated in FIG. 3. In an embodiment for dispensing wet webs 200, the distance d approximates the thickness of the web 200 enabling the web 200 to at least partially seal the dispensing apparatus 1000 to prevent a loss of moisture from the web supply 220. The first dispensing rib 10 and the second dispensing rib 20 oppose each other across the web path 240 but may be offset from one another along the web path 240 as illustrated in FIG. 4.

The turning rib 30 may have a convex, concave or flat edge across the path of the web 200. The edge of the turning rib 30 may be sharp or rounded along the path of the web. In a particular embodiment illustrated in FIG. 6 the turning rib 30 is convex across the web path 240 such that the turning rib 30 protrudes into the plane of the web 200.

Figure 6:
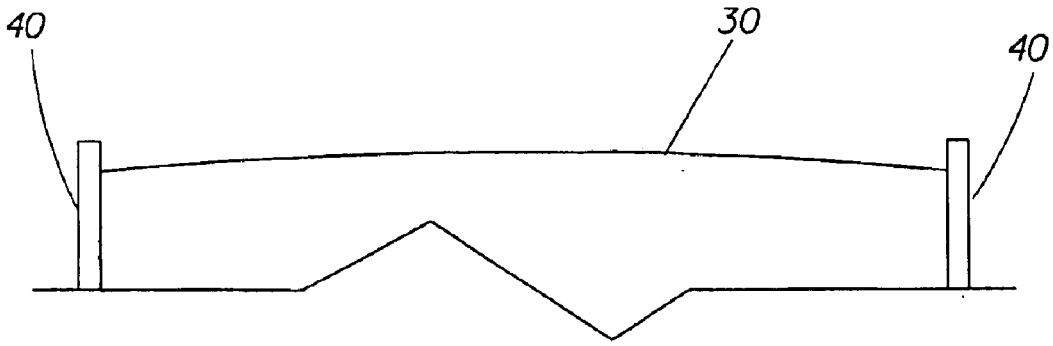
FIG. 6 is a schematic of a particular embodiment of the turning rib viewed along the path of the web material.
Figure 7:
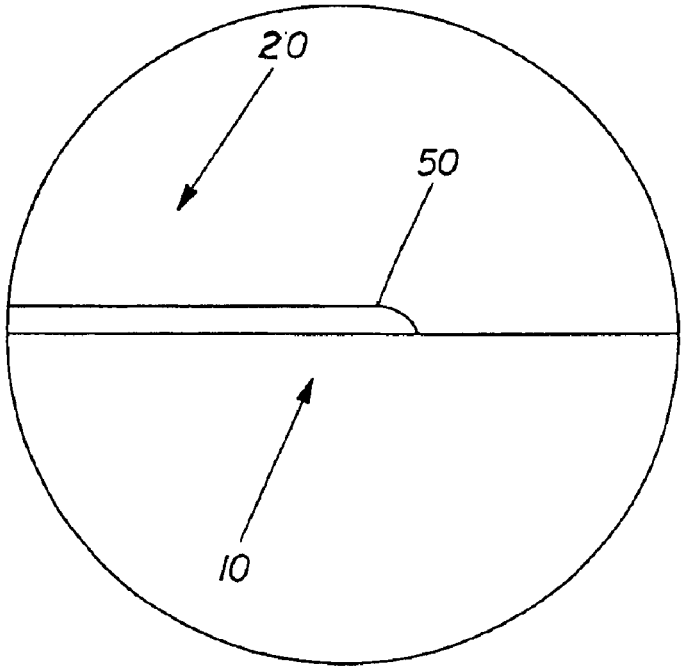
FIG. 7 is a schematic of a particular embodiment of one end of the dispensing orifice.

In the embodiment illustrated in FIG. 6, a transition edge 50 is disposed between the first dispensing rib 10, and the second dispensing rib 20. The transition edge may be radiussed at one end of the dispensing orifice 25 or at each end of the dispensing orifice 25.

Referring to the embodiment illustrated in FIG. 9, a lateral web support 40 is present to support the web supply 220, and to align the web 200, with the dispensing orifice 25. Multiple lateral web supports 40 may be used to constrain the lateral movement of the web supply 220 thereby maintaining the alignment of the web 200 with the dispensing orifice 25.

Figure 8:
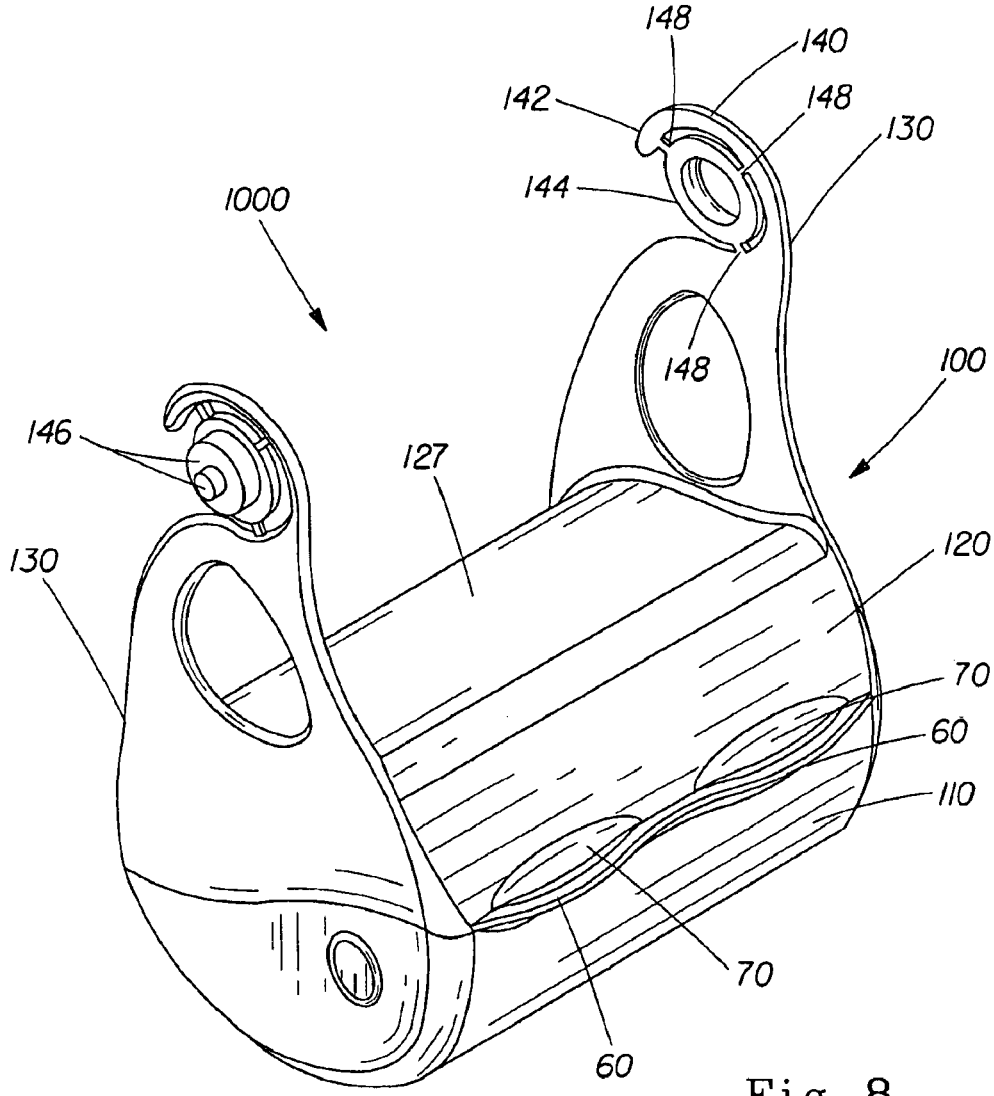
FIG. 8 is a schematic isometric view of an alternative embodiment of the dispensing apparatus.

In the embodiment illustrated in FIG. 8, a first dispensing bill 60 protrudes from the first dispensing rib 10, and a second dispensing bill 70 protrudes from the second dispensing rib 20. The dispensed web 200 passes between the first dispensing bill 60 and the second dispensing bill 70 and is then separated from the web supply 220. The first dispensing bill 60 and the second dispensing bill 70 are disposed opposite each other. By disposed opposite each other it is meant that the first dispensing bill 60 and the second dispensing bill 70 may be directly across from each other or may be partially or completely offset one from the other.

One or more additional dispensing bills may be present. The additional dispensing bills may provide a dispensing bill gap between pairs of dispensing bills on a single dispensing rib such that the web 200 may be grasped for dispensing by the user. The web contacting edges of the first dispensing bill 60 and the second dispensing bill 70 may be sharp, rounded, or serrated. A serrated edge may be used to facilitate separating the web 200 from the web supply 220. The first dispensing bill 60 and the second dispensing bill 70 may be of equal size or may be of different sizes, one dispensing bill may protrude more than another.

The first dispensing bill 60 and the second dispensing bill 70 should protrude far enough from the first dispensing rib 10 and the second dispensing rib 20 that the exposed portion of the web 200 may be easily grasped by the user. In wet wipe dispensing embodiments, the length of the first dispensing bill 60 and the second dispensing bill 70 should not be excessive since the exposed portion of the web 200 is subject to drying due to exposure to an open environment. In an exemplary embodiment, the first dispensing bill 60 protrudes about 10 mm from the first dispensing rib 10; the second dispensing bill 70 protrudes about 6 mm from the second dispensing rib 20.

In the embodiment illustrated in FIGS. 8–10, the dispensing apparatus 1000 comprises a decorative outer shell 100. The design of the decorative outer shell 100 is limited only by the requirements that the decorative outer shell 100 comprise an interior space large enough to accommodate the web supply 220, and that the decorative outer shell 100 include an opening large enough to facilitate placing the web supply 220 in the interior space.

The decorative outer shell 100 may be manufactured from any materials suitable for the intended use of the dispensing apparatus 1000. Wood, metal, cardboard, paper, glass and/or plastic materials may be used in the fabrication of the dispensing apparatus 1000. The dispensing apparatus 1000 may be intended as a disposable—intended for use with a single supply of web material and then discarded when empty—semi durable—for use with multiple refills of a web material before discarding—or durable—as a fixture.

In the embodiment illustrated in FIG. 8 the decorative outer shell 100 comprises a first portion 110 and a second portion 120 hingedly joined to the first portion 110. The portion 110 and second potion 120 may be joined by hinges having portions distinctly affixed to each of the first portion 110 and a second portion 120, or the decorative outer shell 100 may be a single piece with sub portions joined by a living hinge cast into the piece as is known in the art.

Together the first portion 110 and the second portion 120 enclose an interior space large enough to accommodate the web supply 220. In one embodiment for dispensing wet wipes, the first portion 110 comprises a first mating surface 115 along a perimeter. The second portion 120 comprises a mating surface 125 (not shown) that is coextensive with the first mating surface 115. When the decorative outer shell 100 is closed the first mating surface 115 and the second mating surface 125 are juxtaposed with one another to enclose the interior space and the web supply 220 contained therein. FIG. 10 illustrates a sealing flange 117 adapted to overlap the second mating surface 125 along at least a portion of the perimeter of the second portion 120 to provide a moisture resistant seal to preserve the moisture content of the web supply 220. The sealing flange 117 may overlap the second mating surface 125 or may be received into a rabbet 129 in the second mating surface 125. One of skill in the art will appreciate that the sealing flange may alternatively extend from the second mating surface 125 and overlap the first mating surface 115.

In the embodiment illustrated on FIG. 8 the decorative outer shell 100 comprises two mounting elements 130 to facilitate mounting the dispensing apparatus 1000 from a standard receptacle for rolls of bath tissue. In another embodiment, the apparatus may have a single mounting element 130 for hanging the dispensing apparatus 1000, or the dispensing apparatus 1000 may be designed to be disposed on a horizontal surface. In this embodiment, the dispensing apparatus 1000 may comprise additional mass to reduce the tendency of the dispensing apparatus 1000 to move as web materials are dispensed. In another embodiment, the dispensing apparatus 1000 may comprise a mounting element 130 further comprising magnets or suction elements for affixing the dispensing apparatus 1000 to a surface.

The mounting element 130 illustrated in FIG. 8 comprises a filled hook 140. The filled hook 140 further comprising an outer hook 142 and a separably attached piloted flange 144. The piloted flange 144 facilitates the concurrent use of the dispensing apparatus 1000 and a roll of bath tissue on a spindle adapted to hold a roll of bath tissue. The piloted flanges 144 of the mounting elements 130 accept the spindle and allow the spindle to be removed so that the roll of bath tissue may be replaced without the removal of the dispensing apparatus 1000. In one embodiment the piloted flange 144 has a plurality of tiered surfaces 146 to enable the use of the dispensing apparatus 1000 with a wide variety of bath tissue dispensers.

The piloted flange 144 is separably attached to the outer hook 142 by a plurality of attachment pips 148. The attachment pips facilitate the removal of the piloted flange 144 from the outer hook 142. In the embodiment shown in FIG. 8 the attachment pips 148 have are tapered from the piloted flange to the outer hook 142 and are narrower at the outer hook 142 such that the attachment pip 148 will preferentially separate from the outer hook 142 and not from the piloted flange 144. Removing the piloted flanges 144 enables the dispensing apparatus to be suspended from the outer hooks 142.

Figure 11:
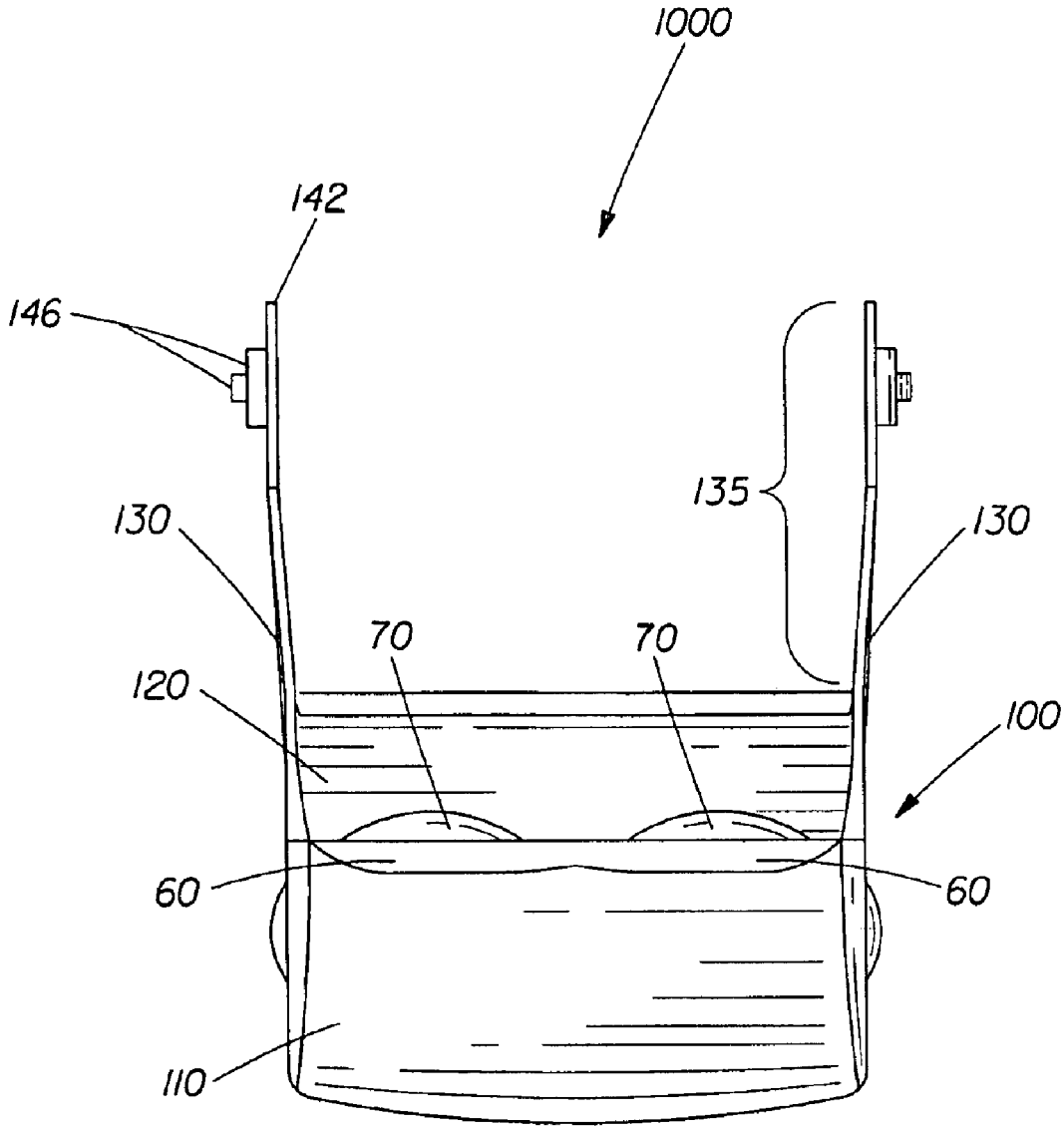
FIG. 11 is a schematic front view of the dispensing apparatus of FIG. 8 showing the tensioning profile of the mounting element.

FIG. 11 illustrates the mounting element 130 comprising a tensioning profile 135. The tensioning profile 135 applies an outward force on the piloted flange 144 such that the dispensing apparatus 1000 remains in place when the spindle for the roll of bath tissue is removed.

In the embodiment illustrated in FIG. 8 the second portion 120 has a top surface 127 that has a concave surface to accommodate the curvature of a roll of bath tissue. The concave top surface 127 enables the distance between the piloted flanges 144 and the second portion 120 to be minimized while still permitting the concurrent use of the dispensing apparatus 1000 with a full size roll of bath tissue or a roll of paper towels.

In the embodiment illustrated in FIG. 9 an intermediate rib 80 is used to support the web supply 220. Intermediate rib 80 is used to limit the contact between the web supply 220, and the decorative shell 100. In embodiments for dispensing wet wipes minimizing the contact between the web supply 220 and the decorative shell 100 reduces the formation of a liquid meniscus between the web supply 220 and the decorative shell 100. A liquid meniscus may increase the drag force present as dispensing of the web 200 proceeds and result in diminished dispensing performance. It is possible that the drag force may exceed the tensile strength of the web 200 resulting in an undesirable web breakage during dispensing. A single intermediate rib 80, or a plurality of intermediate ribs 80 may be used to support the web supply 220.

What is claimed is:

1. A web dispensing apparatus adapted to support a supply of web material, the apparatus comprising:

a support element adapted to support a supply of web material;

a first dispensing rib defining a first edge of a dispensing orifice;

a second dispensing rib opposing the first dispensing rib and defining a second edge of the dispensing orifice;

wherein the web material may pass through the dispensing orifice along a web path;

a turning rib parallel to the dispensing orifice wherein the turning rib comprises a convex edge across the path of the web and wherein an imaginary plane passing through the dispensing orifice parallel to and in the plane of a web path from the web supply passes through the turning rib.

2. The web dispensing apparatus of claim 1 wherein the turning rib alters a dispensing angle of the web path by at least about 60 degrees.

3. The web dispensing apparatus of claim 1 comprising a lateral web support surface essentially perpendicular to the turning rib and the first dispensing rib.

4. The web dispensing apparatus of claim 1 comprising a first transition edge extending from the first edge to the second edge.

5. The apparatus of claim 1 comprising at least one pair of dispensing bills.

6. The apparatus of claim 1 comprising a decorative outer shell.

7. The apparatus of claim 6 the decorative shell comprising a first portion and a second portion hingedly attached to the first portion; the first portion and the second portion each partially enclosing a web holding space and having a mating perimeter.

8. The apparatus of claim 7 comprising a first mounting element protruding from the decorative shell.

9. The dispensing apparatus of claim 8 wherein the first mounting element further comprises a filled hook.

10. The apparatus of claim 9 wherein the filled hook comprises an outer hook and a separably attached piloted flange.

11. The apparatus of claim 10 wherein the piloted flange comprises a plurality of tiered surfaces.

12. The apparatus of claim 10 comprising a plurality of attachment pips extending from the piloted flange to the outer hook.

13. The apparatus of claim 8 further comprising a second mounting element, wherein the first mounting element comprises a tensioning profile.

14. The apparatus of claim 7 comprising a sealing flange along the mating perimeter of at least one of the first portion and second portion.

15. The apparatus of claim 8 wherein the second portion comprises a top surface having a concave profile.

16. The apparatus of claim 1 comprising at least one intermediate web support rib.

17. A web dispensing apparatus comprising:

a) a decorative outer shell and a supply of web material;

b) a first dispensing rib defining a first edge of a dispensing orifice;

c) a second dispensing rib opposing the first dispensing rib and defining a second edge of the dispensing orifice wherein the web material may pass through the dispensing orifice along a web path;

d) a turning rib parallel to the dispensing orifice wherein the turning rib comprises a convex edge across the path of the web and wherein an imaginary plane passing through the dispensing orifice parallel to and in the plane of a web path from the web material supply passes through the turning rib;

e) an intermediate web support rib;

f) a lateral web support surface; and wherein the turning rib alters a dispensing angle of a web path by at least about 60 degrees.

18. A wet wipe dispensing system adapted to support a supply of wet wipes, the system comprising:

a) a wound roll of wet wipe material;

b) a decorative shell comprising a first portion and a second portion hingedly attached to the first portion;

the first portion comprising:

1) a first dispensing rib defining a first edge of a dispensing orifice;

2) a second dispensing rib opposing the first dispensing rib and defining a second edge of the dispensing orifice wherein the wet wipe material may pass through the dispensing orifice along a wet wipe path;

3) a turning rib parallel to the dispensing orifice wherein the turning rib comprises a convex edge across the path of the web and wherein an imaginary plane passing through the dispensing orifice parallel to and in the plane of a wet wipe path from the wet wipe roll passes through the turning rib;

4) a pair of dispensing bills.

19. The wet wipes dispensing system of claim 18 wherein the wound roll of wet wipe material comprises a wet wipe material selectively weakened at non-random intervals.

* * * * *